United States Patent [19]

Ben-Asher

[11] Patent Number: 4,702,095

[45] Date of Patent: Oct. 27, 1987

[54] ELECTRO-MECHANICAL LOCKING DEVICE

[76] Inventor: Eldad Ben-Asher, Shderot Bialik 23, Ramat Hasharon 47206, Israel

[21] Appl. No.: 1,849

[22] Filed: Jan. 9, 1987

[30] Foreign Application Priority Data

Feb. 5, 1986 [IL] Israel ..... 77797

[51] Int. Cl.[4] ..... E05B 47/00

[52] U.S. Cl. ..... 70/279; 70/128; 292/57; 292/201

[58] Field of Search ..... 70/279, 128, 117; 292/57, 58, 59, 60, 61, 62, 201

[56] References Cited

U.S. PATENT DOCUMENTS

| | | | |
|---|---|---|---|
| 1,398,499 | 11/1921 | Burnham | 292/202 |
| 1,654,913 | 1/1928 | Beemer | 292/57 |
| 2,235,949 | 3/1941 | Shaw | 292/59 |
| 2,978,266 | 4/1961 | Poe | 292/57 |
| 3,200,623 | 8/1965 | Peters | 70/279 |
| 4,125,008 | 11/1978 | Genest | 70/279 |
| 4,268,076 | 5/1981 | Itoi | 70/279 |
| 4,573,333 | 3/1986 | Choi | 70/279 |

*Primary Examiner*—Robert L. Wolfe

*Attorney, Agent, or Firm*—Larson and Taylor

[57] ABSTRACT

An electro-mechanical locking device, including a dead bolt having a slot at one end portion and having at its other end portion a tip configured to enter a preformed shaped aperture while assuming at least one orientation and to be blocked by rim portions of said aperture while assuming at least one other orientation and an electrically operable means for applying a rotary movement to a guide member for the dead bolt. The guide member is coupled to the bolt by means of the slot. The device further includes a key operated unlocking and locking actuator means connected to said bolt for effecting linear retraction and extension movements of the bolt when acted upon by the key, while allowing rotary movement of the bolt by said guide member when the guide member is acted upon by the electrically operable means.

5 Claims, 1 Drawing Figure

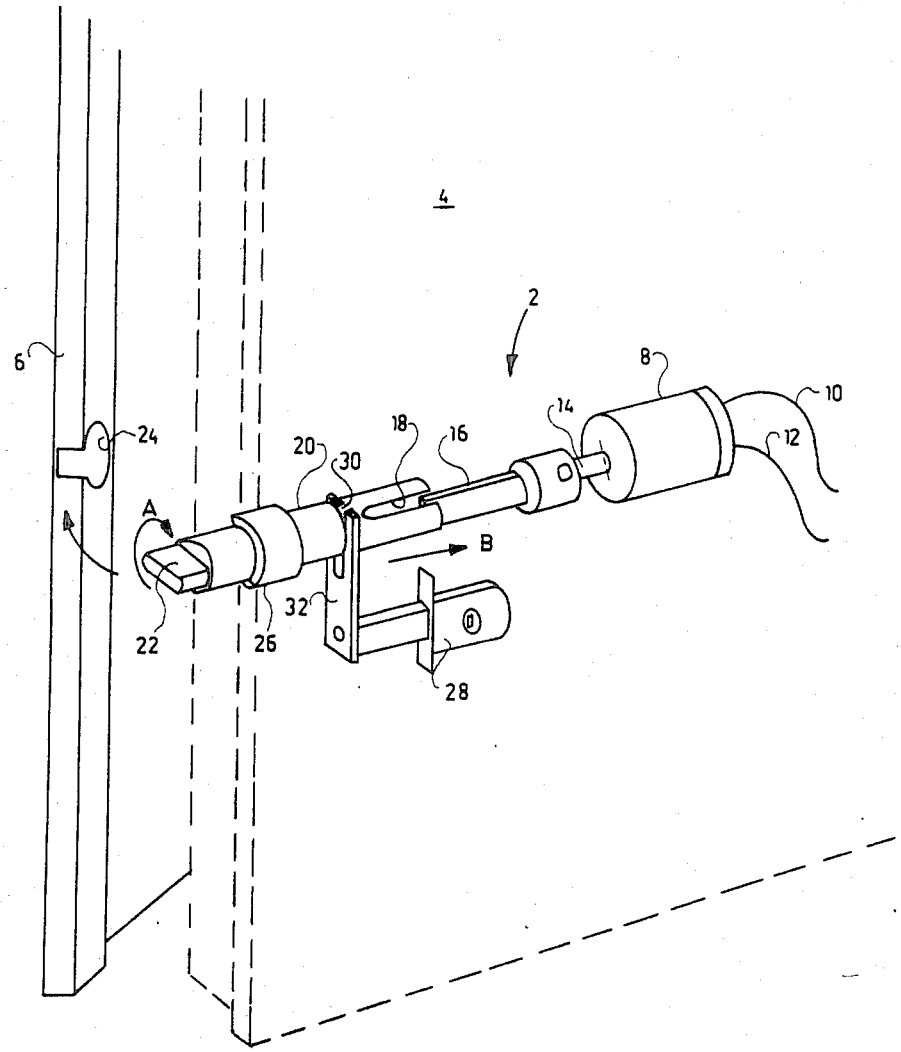
4
2
6
24
8
10
12
14
16
18
20
30
A
B
22
26
32
28

ELECTRO-MECHANICAL LOCKING DEVICE

The present invention relates to a locking device and more particularly to an electro-mechanical locking device, namely, to a locking device which is regularly operated and controlled electrically and/or electronically while having mechanical locking and unlocking means when required, as a back-up safety measure.

The commonly known electrically operated locks comprise a motor capable of rotation in both clockwise and counterclockwise directions for the respective locking and unlocking operations. Also, such locks are provided with mechanical means for converting the rotational movements to linear ones for effecting the locking and unlocking actions similar to the performance of a key operated locking mechanism.

It is a broad object of the present invention to provide an electro-mechanical locking device in which the driving motor may rotate in one sense only.

It is a further broad object of the present invention to provide an electro-mechanical locking device in which there is no need for special means for converting a rotational movement to a linear one, using a rotational motor as drive means.

In accordance with the present invention there is provided an electro-mechanical locking device, comprising a dead bolt having a slot at one end portion and having at its other end portion a tip configured to enter a preformed shaped aperture while assuming at least one orientation and to be blocked by rim portions of said aperture while assuming at least one other orientation;

an electrically operable means for applying a rotary movement to a guide member for the dead bolt, said guide member being coupled to said bolt by means of said slot, and a key opererated unlocking and locking actuator means connected to said bolt for effecting linear retraction and extension movements of said bolt when acted upon by said key, while allowing rotary movement of said bolt by said guide member when said guide member is acted upon by said electrically operable means.

The invention will now be described in connection with certain preferred embodiments with reference to the following illustrative FIGURE so that it may be more fully understood.

With specific reference now to the FIGURE in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Referring now to the preferred embodiment illustrated in the FIGURE, there is seen a locking device 2 according to the present invention as positioned in a door 4 depicted by the broken lines adjacent to a doorpost 6. The door and doorpost may be a regular door and frame therefore of a room, or may constitute a closure to a casing, e.g., a safetybox or the like. The locking device 2 comprises an electrically operated motor 8 which is controlled via input leads 10 and 12 by any desired, not shown, means, for example, an electronic combination switch, a magnetic pass card or the like. The motor 8 may be a simple unidirectional rotary motor whose angle of rotation is controlled by microswitches, a rotary solenoid or any other electrically activated, rotation imparting device. The motor's output rotor stem or axle 14 is connected to a guide member 16, in the shown embodiment, constituted by a bar. The end portion of the member 16 is located inside a slot 18 made at one end of a dead bolt 20. The other end of the bolt 20 is provided with a tip 22 configured to enter a preformed shaped aperture 24 made in the doorpost 6, when said tip assumes a certain orientation. When however the bolt 20 is rotated and assumes a different orientation, the configuration of the tip 22 will prevent the same from entering into, or exiting from, the shaped aperture 24. The bolt 20 is generally in the form of a circular solid rod rotatably supported within a sleeve 26, which sleeve may be welded to, or otherwise attached within, the door 4.

The locking device 2 is further provided with a key operated unlocking and locking actuator 28, which in the shown embodiment, is connected to a peripheral groove 30 made in the bolt, by means of a slotted plate 32. This type of connection allows the free rotation of the bolt inside the slot while providing good coupling between the actuator and the bolt for effecting linear movements when required as will be explained hereinafter.

The operation of the locking device will now be described.

When the motor 8 is activated, it rotates the axle 14 through an angle of, e.g., 90°. Consequently the guide member 16 is similarly rotated and, in turn, rotates the bolt 20 to assume, say, the shown orientation of the tip 22. The door 4 can now be closed since the assumed orientation of the tip now fits the fixed configuration of the aperture 24 in the doorpost. Upon the activation of the motor 8, the bolt will rotate 90° thereby correspondingly rotating the tip 22 inside the aperture 24 in the direction of the arrow A. As can be clearly envisioned, the thusly assumed orientation of the tip 22 inside the shaped aperture 24 will prevent the opening of the door. For unlocking the door, the motor has to be activated again for rotating the tip 22 to the orientation allowing the entering and exiting of said tip through aperture 24.

Circumstances may, however, arise when it will become necessary to open the door mechanically and manually, for example, during power failure or malfunction of the electrically driven motor 8. When such a need arises, the door may be unlocked or locked by means of a suitable key driving the actuator 28. The slotted plate 32 engaging the bolt 20 will move the latter in the direction of the arrow B to unlock the door irrespective of the orientation of the tip 22. The linear movement of the bolt 20 is facilitated by the slot 18 which can slide along the stationary guide member 16 undisturbed.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An electro-mechanical locking device, comprising a dead bolt having a slot at one end portion and having at its other end portion a tip configured to enter a preformed shaped aperture while assuming at least one orientation and to be blocked by rim portions of said aperture while assuming at least one other orientation;

an electrically operable means for applying a rotary movement to a guide member for the dead bolt, said guide member being coupled to said bolt by means of said slot, and a key operated unlocking and locking actuator means connected to said bolt for effecting linear retraction and extension movements of said bolt when acted upon by said key, while allowing rotary movement of said bolt by said guide member when said guide member is acted upon by said electrically operable means.

2. The locking device as claimed in claim 1 wherein said dead bolt is a substantially circular solid rod, further provided with a sleeve coupled thereon adjacent to said tip.

3. The locking device as claimed in claim 1, wherein said guide member for the dead bolt is a bar connected at one end to said electrically operable means and having a portion configured to slide in the slot of said bolt.

4. The locking device as claimed in claim 1 wherein said electrically operable means is an electric motor.

5. The locking device as claimed in claim 4 wherein said electric motor is provided with means for controlling rotation through one angle of about 90° when actuated.

* * * * *